United States Patent [19]

Seki et al.

[11] 4,387,884

[45] Jun. 14, 1983

[54] STRUCTURE OF OXYGEN PASSAGE IN STEEL CONVERTER VESSEL SUPPORTING TRUNNION

[75] Inventors: Masahiko Seki; Koji Wada; Yukito Io, all of Kitakyushu, Japan

[73] Assignee: Nippon Steel Corporation, Tokyo, Japan

[21] Appl. No.: 341,151

[22] Filed: Jan. 20, 1982

[30] Foreign Application Priority Data

| | | | |
|---|---|---|---|
| Jan. 21, 1981 | [JP] | Japan | 56-5779[U] |
| Jan. 22, 1981 | [JP] | Japan | 56-6511[U] |
| Jan. 22, 1981 | [JP] | Japan | 56-6512[U] |
| Feb. 4, 1981 | [JP] | Japan | 56-13654[U] |

[51] Int. Cl.[3] ..... C21C 5/50

[52] U.S. Cl. ..... 266/246; 266/247

[58] Field of Search ..... 266/246, 247

[56] References Cited

U.S. PATENT DOCUMENTS

| | | | |
|---|---|---|---|
| 4,195,985 | 4/1980 | Brotzmann | 75/60 |
| 4,198,230 | 4/1980 | Brotzmann | 75/60 |
| 4,284,266 | 8/1981 | Nagati | 266/246 |

*Primary Examiner*—P. D. Rosenberg

*Attorney, Agent, or Firm*—Wenderoth, Lind & Ponack

[57] ABSTRACT

A structure of the oxygen passage in a steel converter supporting trunnion comprises a hollow chamber provided where a trunnion shaft projects from a trunnion ring. In the hollow chamber is inserted a hermetic manifold, to which a horizontal pipe communicating with a rotary joint and a vertical pipe communicating with an oxygen tuyere in the bottom of the converter vessel are welded. Inside the manifold, there is fitted a communicating member containing a bend-like passage through which the horizontal and vertical pipes communicate with each other.

6 Claims, 15 Drawing Figures

STRUCTURE OF OXYGEN PASSAGE IN STEEL CONVERTER VESSEL SUPPORTING TRUNNION

BACKGROUND OF THE INVENTION

This invention relates to a device that supplies oxygen to oxygen tuyeres provided in the hearth bottom or in the lower portion of the hearth side walls of a steel converter vessel. More particularly, it relates to the structure of an oxygen passage provided in the bearing section of a trunnion ring.

In that portion of a trunnion ring from which a trunnion shaft projects, generally, there are provided a horizontal opening extending in the same direction as the shaft and a vertical opening communicating with the horizontal one. A horizontal pipe is inserted in the horizontal opening so as to communicate with a rotary joint attached to one end of the shaft, and a vertical pipe is inserted in the vertical opening so as to communicate with the horizontal pipe.

To prevent the leakage of oxygen, the connecting structure and vertical pipe, provided where the horizontal and vertical openings meet, have conventionally been covered with an O-ring or other suitable sealing means. Nevertheless, oxygen leakage has not been completely prevented because of the large diameter of the vertical pipe, approximately 150 to 300 mm, and the difference in the extent to which the trunnion shaft and pipes expand when heated. To solve this problem, the inventor invented a structure in which a window is provided on the furnace side, i.e. the side that is attached to the furnace, of a trunnion ring so that the vertical pipe and manifold can be easily welded together therethrough (Japanese Patent Publication No. 72,113 of 1981). But this structure still involved the danger that the oxygen flowing from the horizontal pipe to the vertical pipe, whirls and is liable to cause combustion.

It is well-known that the refractory lining of the converter vessel wears out as the number of heats the vessel undergoes increases. Especially toward the end of a furnace operating program, the refractory lining becomes so thin that the steel shell temperature rises greatly. It can reach 700° to 800° C. where the lining wear is heavy. In extreme cases, the steel shell melts away which causes an outflow of molten steel. Especially, the lining on the inside of that portion of the steel shell to which the shaft of the trunnion ring is attached is in constant contact with slag (having a high brick-eroding power), irrespective of the angle through which the vessel is tilted. Located, in addition, where castable flame gunning is difficult to apply, this portion has a greater chance than elsewhere of causing a dangerous metal outflow.

In the conventional vessel having an oxygen passage running through its trunnion, the overheating or erosion of the steel shell on the inside thereof can exert a similar thermal or chemical effect on the trunnion, thereby giving rise to explosive oxygen-induced combustion.

With the conventional vessel, furthermore, the horizontal pipe extends from a rotary joint, and is supported midway by a flange fastened to the end surface of the trunnion ring shaft. When the furnace is in operation, the shaft becomes hot under the effect of the heat from the vessel, whereas the horizontal pipe remains not quite so hot, giving rise to a difference in the extent of thermal expansion. This expansion difference can cause a leakage from the pipe-end joint or a bend in the vertical pipe. The leakage and bend, in turn, bring the oxygen in contact with dust, rust or such combustible gases as LPG, resulting in the danger of explosion, either inside or outside the trunnion.

SUMMARY OF THE INVENTION

This invention has been made with a view to solving the aforementioned problems with the oxygen passage provided in the trunnion of the steel converter vessel.

An object of this invention is to provide an oxygen passage in the steel converter vessel supporting trunnion having a structure which prevents the oxygen-induced combustion by forestalling the development of whirls in the oxygen stream running through the manifold.

Another object of this invention is to provide an oxygen passage in the steel converter vessel supporting trunnion having a structure which prevents the explosive oxygen-induced combustion by keeping the oxygen passage away from the influence of the heat from the converter vessel.

Still another object of this invention is to provide an oxygen passage in the steel converter vessel supporting trunnion having a structure which assures a tight sealing by steadily supporting the load applied by the weight and vibration of the supply pipe connected to the rotary joint and the horizontal pipe within the trunnion, absorbing the difference in expansion between the trunnion shaft and horizontal pipe, and absorbing the misalignment between the horizontal pipe and rotary joint.

The oxygen passage in the converter vessel trunnion according to this invention has a hollow chamber provided in that portion of the trunnion from which the trunnion shaft projects, with a hermetic pipe connecting member inserted therein. To the member is connected, by welding, a horizontal pipe communicating with the rotary joint and a vertical pipe communicating with the oxygen tuyeres provided in the hearth. A pipe connector means built in the pipe connecting member has a bend-like passage that connects the horizontal pipe with the vertical pipe.

With the horizontal and vertical pipes welded to the hermetic pipe connecting member, the oxygen passage of this invention is leakage-free since it has no joint where different members expand at different rates as in the conventional passageways. The built-in pipe connector means with the bend-like passage prevents the occurrence of oxygen whirls and, therefore, combustion inside the pipe connector means.

According to this invention, a shield and/or a refractory layer is provided on the vessel-side of the manifold. This shield and/or refractory layer protects the oxygen passage even if part of the vessel becomes sufficiently eroded to allow the hot metal within to flow out.

In this invention, furthermore, the horizontal pipe and the supply pipe extending from the rotary joint are joined together by a coupler having a cylindrical portion, at the end of the trunnion ring shaft, with the rear end of the horizontal pipe and the front end of the supply pipe fitted in the cylindrical portion of the coupler. Accordingly, even if any difference in expansion occurs between the shaft and horizontal pipe, the rear end of the horizontal pipe, being inserted in the cylindrical portion of the coupler, can move freely, whereby both the horizontal and vertical pipes remain unaffected by undesirable stress. Similarly, any misalignment between the horizontal pipe and rotary joint can be easily absorbed.

DETAILED DESCRIPTION OF THE INVENTION

Figure 1:
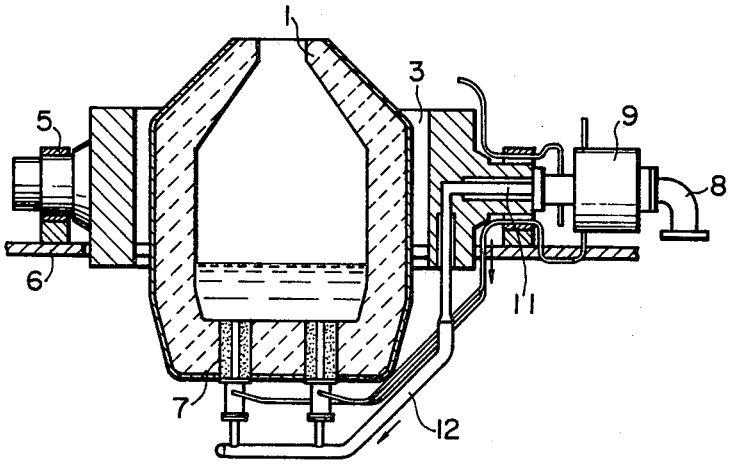
FIG. 1 is a cross-sectional view showing the principal part of a steel converter vessel to which this invention is applicable.

FIG. 1 shows a steel converter vessel to which this invention is applied. A trunnion 3 supporting a vessel 1 is rotatably supported on the operating floor 6 by way of a bearing 5. Tuyeres 7 admitting oxygen, inert gas, LPG, etc. are provided in the bottom of the vessel 1. Oxygen gas is supplied to the tuyeres 7 from an entry pipe 8 by way of a rotary joint 9, a passage 11 inside the trunnion 3, and a pipe 12.

Figure 2:
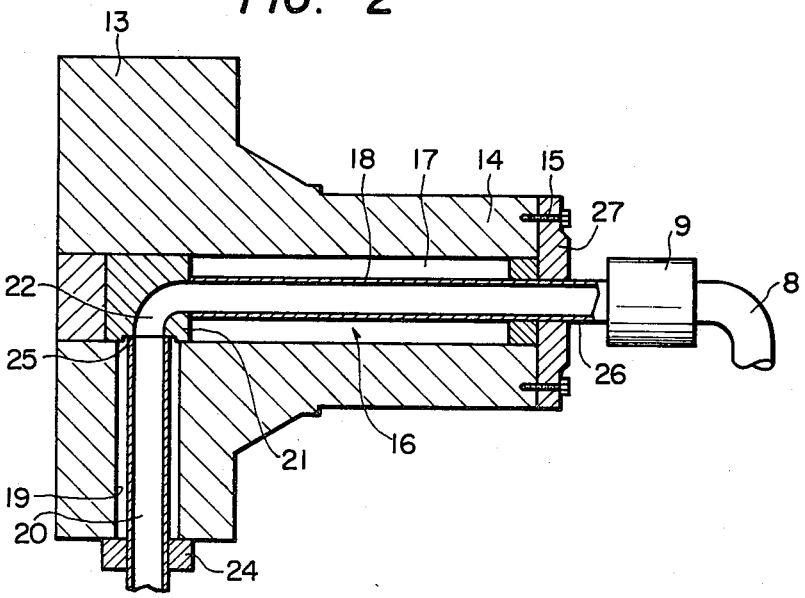
FIG. 2 is a cross-sectional view showing an example of conventional passage structure.

FIG. 2 shows a passage structure 16 in a conventional trunnion 13. The passage structure 16 comprises a horizontal pipe 18 inserted in a horizontal opening 17, a vertical pipe 20 inserted in a vertical opening 19, and a block 21 connected therebetween. The block 21 has a perpendicularly bent bend-like passage 22 to communicate the exit end of the horizontal pipe 18 with the entry end of the vertical pipe 20. The exit end of the horizontal pipe 18 is welded to the block 21. The entry end of the vertical pipe 20 is pressed, from below, against the block 21 by a nut 24, with a seal being maintained by means of an O-ring interposed therebetween.

In this type of passage structure, however, the nut 24 on the vertical pipe 20 must be so large that it is difficult to tighten it securely and, therefore, assure a tight seal between the block 21 and vertical pipe 20. It is also likely that the nut 24 will seize under the intense heat transmitted from the vessel in operation.

Also, the heated trunnion 13 expands at a different rate from the pipes 18 and 20, whereupon the pipes 18 and 20 move axially and may develop a leak between the block 21 and pipe 20.

Figure 3:
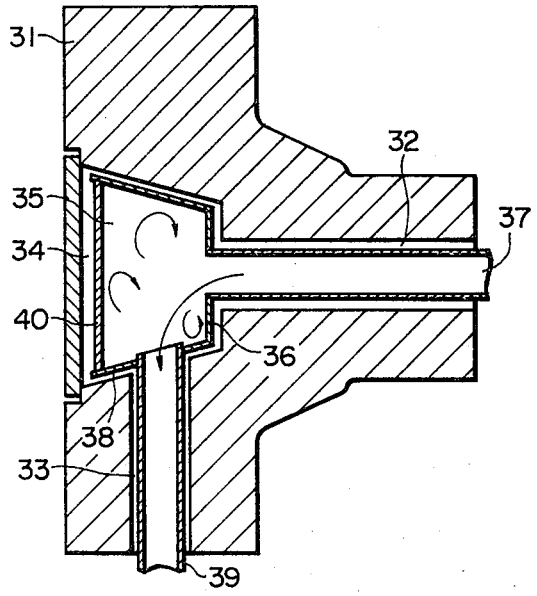
FIG. 3 is a cross-sectional view showing an improvement in the passage structure shown in FIG. 2.

FIG. 3 shows an improvement the inventor has made over the above-described passage structure of the conventional type. As shown, there is provided a hollow chamber 34 in a trunnion 31 where a horizontal opening 32 and a vertical opening 33 meet, with a manifold 35, shaped like a conical cone, inserted therein. To the vertical front wall 36 of the manifold 35, which faces the horizontal opening 32, is welded the exit end of the horizontal pipe 37 so as to communicate with the inside of the manifold 35. To the peripheral wall 38 of the manifold 35 is welded the upper, entry end of the vertical pipe 39 so as to communicate with the inside of the manifold 35. After the horizontal and vertical pipes have been thus welded, the rear wall 40 is attached and hermetically welded.

To permit the welding operation needed to make up this passage structure, the space within the manifold 35 must be considerably larger than the diameter of the pipes. But when a stream of oxygen flows from the horizontal pipe 37 into such a spacious manifold 35, part of the oxygen stream whirls in the corner of the manifold 35. The whirling oxygen stream creates the danger of causing combustion.

Now a preferred embodiment of this invention will be described in the following with reference to the accompanying drawings.

Figure 4:
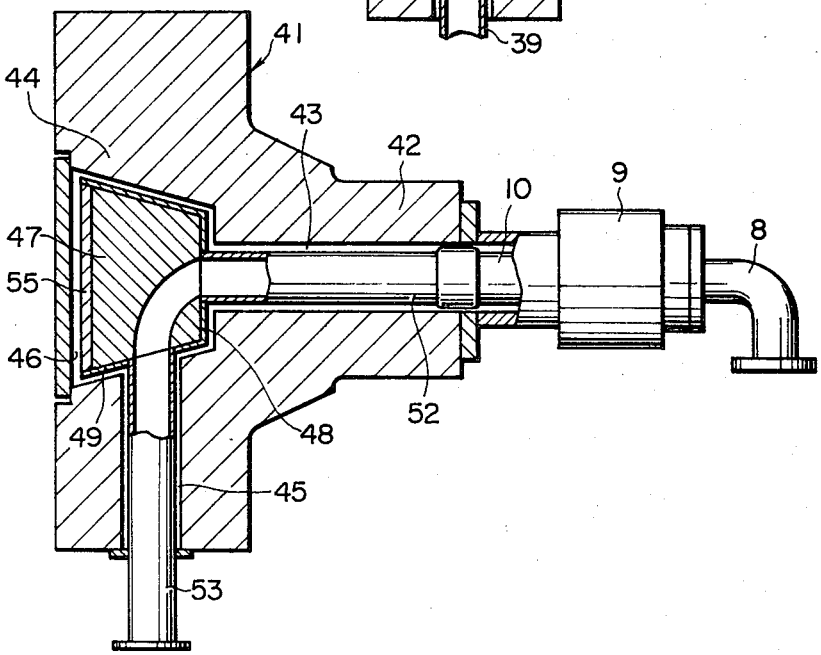
FIG. 4 is a cross-sectional view of a passage structure according to this invention.
Figure 5:
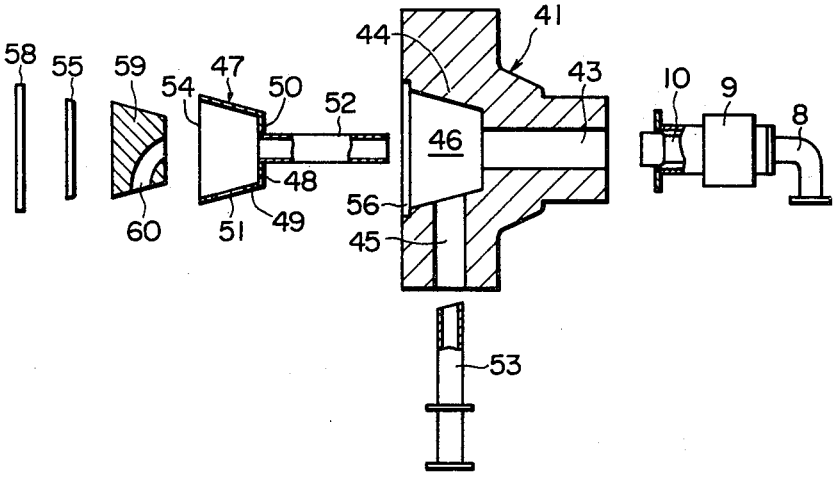
FIG. 5 is an exploded view of the passage structure shown in FIG. 4.

As shown in FIGS. 4 and 5, there are provided a horizontal opening 43, extending parallel to a trunnion shaft 42, in a trunnion 41 that rotatably supports a top-and-bottom blown steel converter vessel, and a vertical opening 45 communicating with said horizontal opening 43 in the base portion 44 of the trunnion shaft 42.

A hollow chamber 46 is provided where the horizontal opening 43 and vertical opening 45 meet. The hollow chamber 46 opens on the vessel-side of the trunnion 41. A hollow pipe connecting member 47, shaped like a conical cone and complementary in shape to the chamber 46, is inserted in the hollow chamber 46. There are provided openings 50 and 51 in the front wall 48 and peripheral wall 49 of the pipe connecting member 47, respectively. To the front wall 48 is attached the horizontal pipe 52 so as to open into the member 47 through the opening 50. To the peripheral wall 49 is attached the vertical pipe 53 so as to open into the member 47 through the opening 51. The member 47 has another opening 54 in its rear side, which is closed by a cover plate 55.

Figure 6:
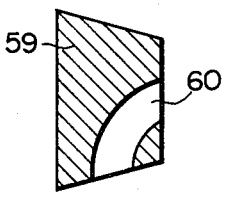
FIG. 6 is a cross-sectional view of a pipe connector means used in the passage structure of this invention.
Figure 7:
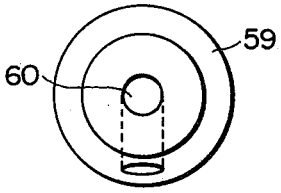
FIG. 7 is a front view of the pipe connector means shown in FIG. 6.

The pipes 52 and 53 and the pipe connecting member 47 are fitted in the trunnion 41 as follows:

The horizontal pipe 52, carrying the preassembled pipe connecting member 47 at one end thereof, if first inserted into the horizontal opening 43, then the member 47 is fitted in the hollow chamber 46. The other end of the horizontal pipe 52 is connected to a support pipe 10 extending from a rotary joint 9. The vertical pipe 53 is inserted in the vertical opening 45. The two pipes 52 and 53 are welded to the member 47 through a window 56 on the vessel-side of the trunnion shaft base 44. To permit this welding operation, the rear opening 54 of the member 47 has a diameter of 300 mm or larger. When the horizontal and vertical pipes 52 and 53 have been welded, a pipe connector means in the form of a truncated conical block, 59, having a 90-degree-bent passage 60 therein to provide a communication between pipes 52 and 53, is loosely fitted in the member 47 (see FIGS. 6 and 7), and then the rear end of the member 47 is hermetically sealed by the cover plate 55.

It is preferable that the horizontal and vertical pipes 52 and 53, pipe connecting member 47, and block 59 be either made of such combustion-proof materials as stainless steel, Ni-Cr alloy, Ni-Cu alloy, Ni, Cr and ceramic or covered with protective coatings applied by metal spraying or some other explosive method.

When the pipe connecting member 47 and other components have been thus fitted, the hollow chamber 46 is closed with a cover plate 58.

With the bend-like passage 60 provided in the block 59, whirls no longer occur in the oxygen flowing into the pipe connecting member 47, thereby assuring a smooth flow. Greater safety results from keeping the oxygen stream out of direct contact with the trunnion that becomes very hot because of the heat transmitted from the vessel. Despite the expansion of the trunnion caused by the same heat conduction, the pipes can be perfectly sealed, thereby preventing the leakage of oxygen.

Figure 8:
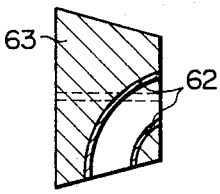
FIG. 8 is a cross-sectional view showing another embodiment of the coupling member.
Figure 9:
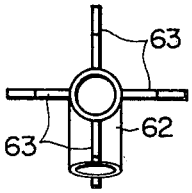
FIG. 9 is a front view of the pipe connector means shown in FIG. 8.

The passage structure of this invention is not limited to the one described above. For example, the pipe connector means can be a plurality of webs constituting support members 63 attached to the peripheral surface of a communicating bent pipe 62, as shown in FIGS. 8 and 9, instead of the block structure. With the edge of the support members 63 snugly matching with the internal surface of the pipe connecting member 47, the pipe 62 is suspended inside the member 47.

This latter structure permits making the passage structure with less material, and reduces the thermal conduction to the member 47, decreasing the danger of oxygen-induced combustion in the bent pipe.

Figure 10:
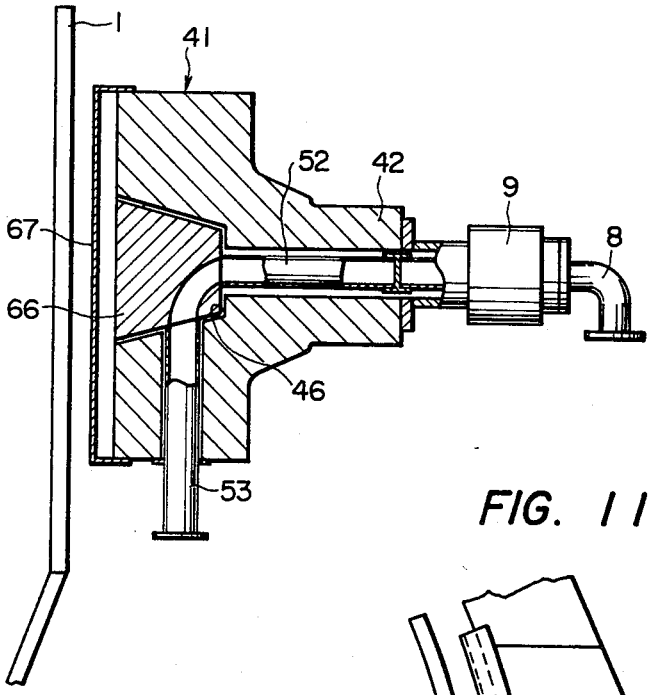
FIG. 10 is a cross-sectional view showing another embodiment of the passage structure according to this invention.
Figure 11:
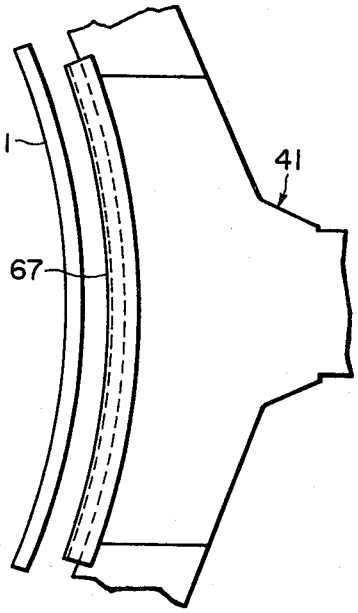
FIG. 11 is a plan view of the passage structure shown in FIG. 10.

FIGS. 10 and 11 show another embodiment of this invention. As seen, this embodiment differs from the first embodiment in that a heat shield 67 is added. The heat shield 67 is attached to that side of the trunnion 41 which faces the vessel 1 so that the surface 66 of the passage structure facing the vessel 1 is protected from the surface of the vessel 1. An appropriate clearance is left between the surface of the trunnion 41 and the heat shield 67 to prevent the transmission of heat from the heat shield 67.

Because the heat shield 67 covers the vessel-side of the passage structure, the oxygen flowing therethrough is protected against heating and combustion that can occur when the steel shell of the vessel becomes overheated as a result of the erosion of the refractory lining.

Even if molten steel flows out through an opening in such an overheated steel shell, the steel is diverted downward by the heat shield 67, away from the trunnion shaft 42.

To forestall these dangers makes it possible to prevent the occurrence of such accidents that can turn out to be disastrous. This structure also is simple, durable and practically effective.

Figure 12:
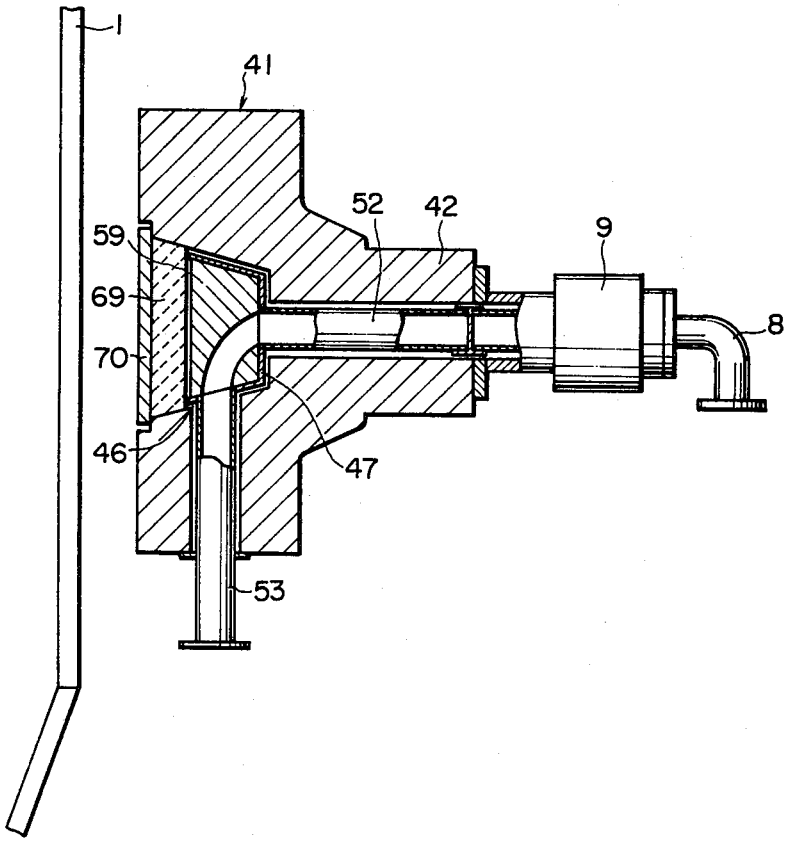
FIG. 12 is a cross-sectional view showing still another embodiment of the passage structure according to this invention.

FIG. 12 shows still another embodiment of this invention. This embodiment differs from the above-described passage structure in that refractory 69 is buried in the hollow chamber 46 on the vessel-side of the manifold, and covered with a cover plate 70.

Figure 13:
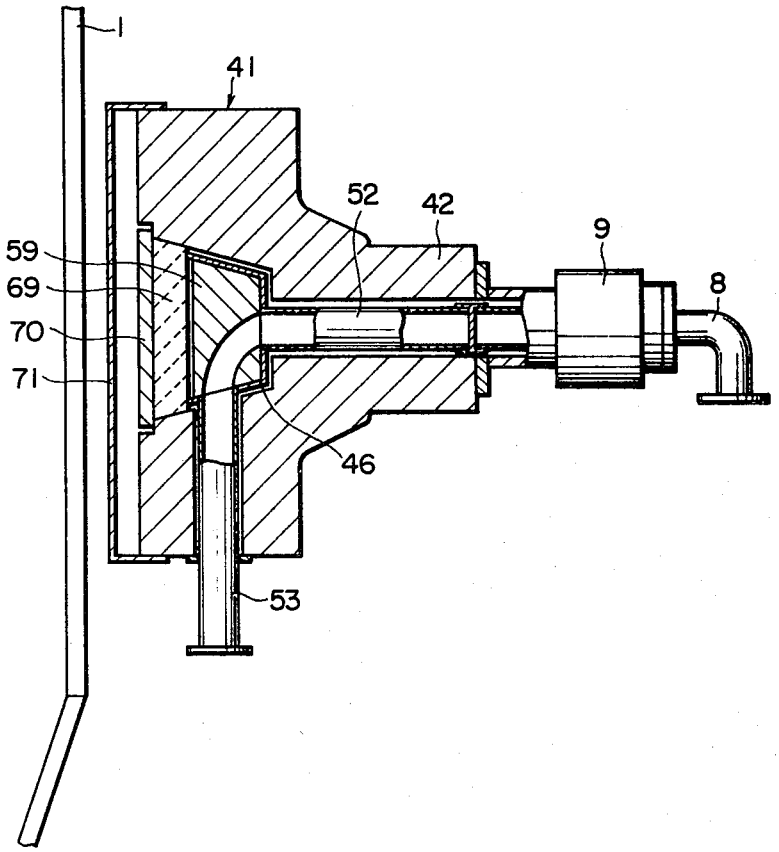
FIG. 13 is a cross-sectional view showing yet another embodiment of the passage structure according to this invention.

FIG. 13 shows yet another embodiment of this invention similar to the one in FIG. 12, except that a heat shield 71 is provided to reduce the effect of the radiant heat from the converter vessel 1, as with the embodiment shown in FIG. 10.

The embodiments in FIGS. 12 and 13 feature the refractory 69 buried on the vessel-side of the block 59. Even if the steel shell breaks and molten steel flows toward the trunnion shaft 42, the refractory 69 safely protects the oxygen in the passage against the danger of heating, ignition and combustion.

The following paragraphs describe how the horizontal pipe and rotary joint are connected together.

FIG. 2 shows the conventional method of connection. That is, the supply pipe 26 extending from the rotary joint 9 and the horizontal pipe 18 are the same pipe. A fastening flange 27 is attached directly to the outside of the supply pipe 26. The fastening flange 27 is attached to the end surface 15 of the trunnion shaft 14.

In this case, the load resulting from the weight and vibration of the supply pipe 26 is supported by the fastening flange 27 directly attached thereto. On the other hand, the trunnion shaft 14 axially elongates when heated by the converter vessel during operation, whereas the horizontal pipe 18, kept away from the heat, does not elongate so much. This difference in expansion causes the joint 25 with the vertical pipe 20 to misalign, which in turn gives rise to a leakage of the gas supplied therethrough or a bending of the vertical pipe 20 as it is forcibly pressed.

Several kinds of gases can be passed through the passage in the trunnion. In a bottom-blown converter, they are oxygen for refining and LPG or other protective gas for cooling the tuyeres, which are all explosive. Therefore, if such leakage or bend as mentioned above occurs, these gases can burn or explode either inside or outside the trunnion.

Figure 14:
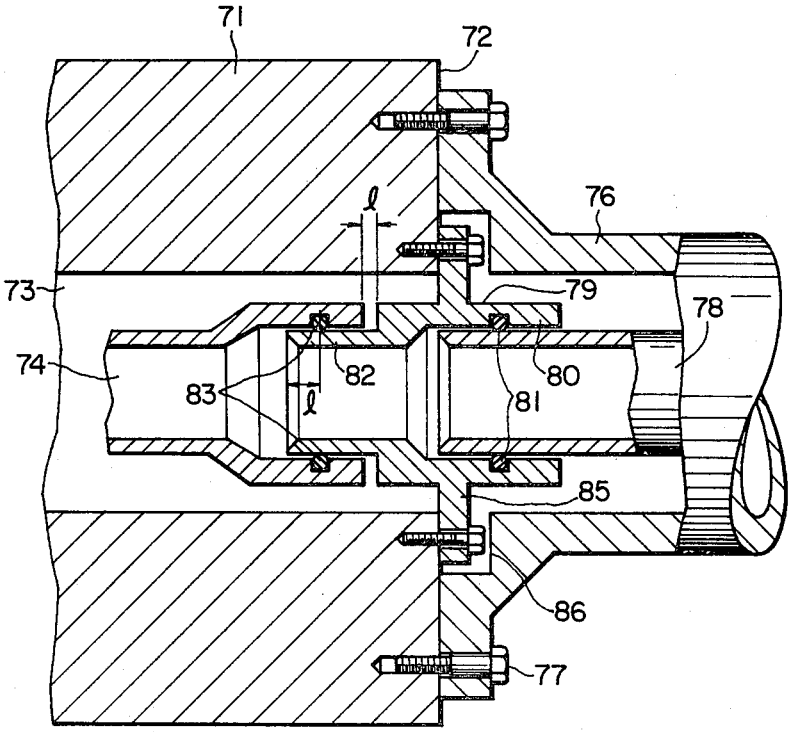
FIG. 14 is a cross-section view showing means for coupling together a horizontal pipe and a supply pipe extending from a rotary joint in the passage structure according to this invention.

FIG. 14 shows a coupling means that has solved the problem just described. As illustrated, a rotary joint 76 is attached to the end surface 72 of a trunnion shaft 71 with bolts 77 or other fastening means. A supply pipe 78 feeding a refining or protective gas runs through the center of the rotary joint 76. Meanwhile, a horizontal pipe 74 to supply the refining or protective gas to the nozzle in the vessel bottom is provided inside a horizontal opening 73 in the trunnion shaft 71. The supply pipe 78 inside the rotary joint 76 and the horizontal pipe 74 are joined together by means of a coupler 79 interposed therebetween. The supply pipe 78 in the rotary joint 76 is fitted in the entry-side cylindrical portion 80 of the coupler 79. An O-ring or other sealing means 81 is provided in the annular clearance between internal surface of the entry-side cylindrical portion 80 and the external surface of the supply pipe 78. The exit-side cylindrical portion 82 of the coupler 79 is fitted in the horizontal pipe 74, with an O-ring or other sealing means 83 provided in the annular clearance between the external surface of the exit-side cylindrical portion 82 and the internal surface of the horizontal pipe 74. This arrangement permits the horizontal pipe 74 and exit-side cylindrical portion 82 to slide, while keeping a perfect sealing, over a distance l to absorb the difference in axial expansion between the trunnion shaft 71 and horizontal pipe 74.

The coupler 79 has a flange 85 on its outside, and the flange 85 is fastened to the end surface 72 of the trunnion shaft 71 with bolts or other fastening means 86.

Figure 15:
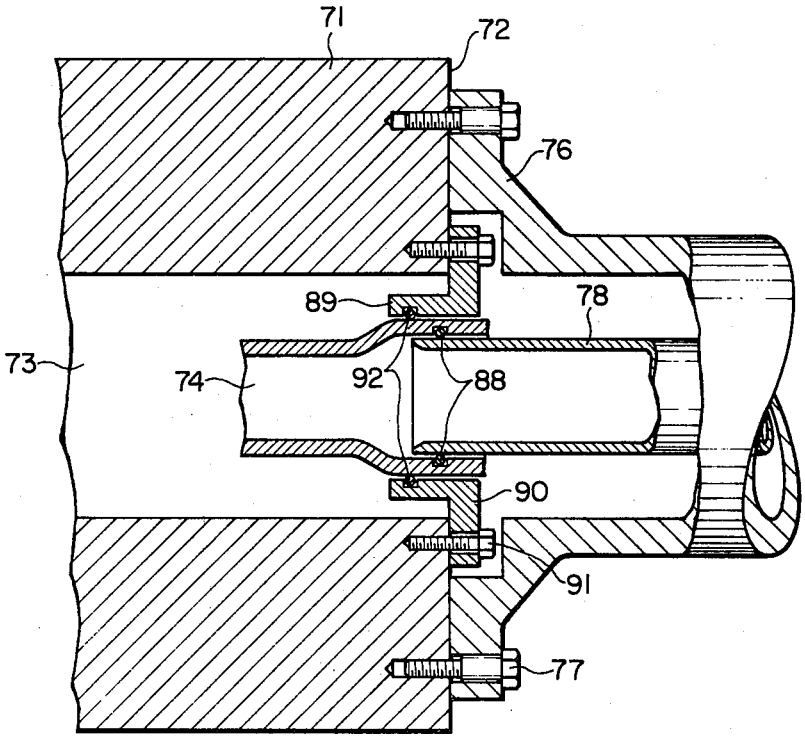
FIG. 15 is a cross-sectional view showing another embodiment of the coupling means.

FIG. 15 shows another embodiment of the coupling means according to this invention, which is attached to the end surface 72 of the trunnion shaft 71 with bolts or other fastening means 77. The exit end of the supply pipe 78 running through the center of the rotary joint 76 is fitted in the entry end of the horizontal pipe 74. A sealing means (a packing such as an O-ring) is provided between the supply pipe 78 and horizontal pipe 74. The flange 90 of a metal support 89 is fastened to the end surface 72 of the trunnion shaft 71 with bolts or other fastening means 91. The horizontal pipe 74 is fitted in the metal support 89, with an O-ring or other sealing means 92 interposed therebetween. The metal support 89 fastened to the trunnion shaft 71 supports the horizontal pipe 74.

The conventional one-piece trunnion structure, made up of a rotary joint, supply pipe, horizontal pipe, etc., has been able to absorb, to a certain extent, the play caused by the vibration of the converter vessel during operation and the weight of the pipes themselves. Yet, the conventional structure has been unable to prevent the expansion of the trunnion shaft due to the heat transmitted from the hot vessel during operation and the strain developed between the horizontal and supply pipes through which a refining or protective gas of ordinary temperatures runs. In the passage structure according to this invention, in contrast, the horizontal pipe 74 and supply pipe 78 are slidably joined together through a coupler 79 or 89. Also, there is no danger of the refining or protective gas to leak, since a perfect sealing is secured by means of the sealing means between the internal surface of the horizontal pipe 74 and the external surface of the coupler 79, and the sealing means 81 between the internal surface of the other end of the coupler 79 and the external surface of the supply pipe 78 contained in the rotary joint. In addition, the horizontal pipe 74 slides over the external surface of the coupler 79 as the trunnion shaft 71 expands, which permits absorbing the difference in expansion therebetween and keeping the horizontal pipe 74 free from external pressure and fracture. This eliminates the danger of the outflow, combustion and explosion of the refining or protective gas flowing inside the pipes.

Conventionally, the rotary joint 76 has often been fastened to the end surface 72 of the trunnion shaft 71 with reamer bolts 77 to prevent the play due to the weight and vibration of the pipes. Yet, if the horizontal pipe 74 is eccentric relative to the axis of the trunnion shaft 71, and the supply pipe 78 relative to the axis of the rotary joint 76, the horizontal pipe 74 and supply pipe 78 cannot be joined together at all or at least not with satisfactory sealing unless the coupler 79 is used, since the center of the horizontal pipe 74 does not align with that of the supply pipe 78 being restrained by the rotary joint fastening reamer bolts 77. In contrast, the use of the coupler 79 according to this invention permits hermetically joining together even an eccentrically disposed horizontal pipe 74 and supply pipe 78, without modifying the horizontal pipe 74 and rotary joint 76, by adjusting the center of the entry-side cylindrical portion 80 of the coupler 79 to that of the supply pipe 78 and the center of the exit-side cylindrical portion 82 to that of the horizontal pipe 74.

If a slight amount of leakage to the space between the trunnion shaft 71 and horizontal pipe 74 and the space between the rotary joint 76 and supply pipe 76 occurs, and such spaces are hermetically sealed from the atmosphere, the sealing means 81 and 83 and/or 88 and 92 may be eliminated.

What is claimed is:

1. An oxygen passage structure in a supporting trunion for a steel converter vessel, which trunion has a trunion ring with a trunion shaft projecting radially and said shaft having a horizontal opening therein opening out of the end surface thereof, said horizontal opening extending parallel with the axis of the trunion shaft, said trunion further having a vertical opening opening out of the bottom surface of the trunion and having the axis intersecting the axis of said horizontal opening, and said trunion having a hollow chamber therein into which said horizontal and said vertical openings open and which chamber is open through the wall of said trunion ring toward the converter vessel, said oxygen passage structure comprising:

a horizontal pipe inserted in said horizontal opening and being adapted to be connected with a supply pipe;

a vertical pipe inserted in said vertical opening, the vertical pipe being adapted to be connected with an oxygen tuyere in the converter vessel;

a hollow pipe connecting member having a shape complementary to the shape of said hollow chamber and positioned in said hollow chamber, the end of said horizontal pipe which is toward said chamber being welded to said pipe connecting member and the end of said vertical pipe which is toward said chamber being welded to said hollow pipe connecting member; and a pipe connector means mounted in said hollow pipe connecting member and having a passage therethrough extending from said horizontal pipe to said vertical pipe for connecting said pipes, said pipe connector means having support means thereon engaged with the inner surfaces of the walls of said hollow pipe connecting member for supporting said passage in a position in said pipe connecting member in which the ends of said passage are aligned with said horizontal and vertical pipes.

2. An oxygen passage structure as claimed in claim 1 further comprising a heat shield attached to said trunion and covering the opening of said hollow chamber toward the vessel.

3. An oxygen passage structure as claimed in claim 1 in which said pipe connector means is a block of combustion-proof material with said passage extending through said block, said block having a shape complementary to the inside of said pipe connecting member, the surfaces of said block engaging the inner surfaces of the walls of said pipe connecting member and constituting said support means.

4. An oxygen passage structure as claimed in claim 1 in which said pipe connector means comprises a curved pipe having said passage therein, and said support means comprises webs on the outside of said pipe and having the outer edges engaged with the inner surfaces of the walls of said pipe connecting member.

5. An oxygen passage structure as claimed in claim 1 further comprising an expansion and load carrying joint at the end of said horizontal pipe away from said chamber, said joint comprising a coupling member having a cylindrical portion facing toward said horizontal pipe with the end of said horizontal pipe engaged therewith with sliding sealing means between said cylindrical portion and said horizontal pipe, a further cylindrical portion facing away from said horizontal pipe and having sliding sealing means thereon and adapted to engage in sliding and sealing engagement with the supply pipe, and means on said coupling member for fastening said coupling member to the end surface of the trunion shaft.

6. An oxygen passage structure as claimed in claim 1 further comprising an expansion and load carrying joint at the end of said horizontal pipe away from said chamber, said joint comprising a coupling member having a cylindrical portion facing toward said horizontal pipe with the end of said horizontal pipe engaged therewithin with sliding sealing means between said cylindrical portion and said horizontal pipe, the interior of said horizontal pipe within said cylindrical portion having sliding sealing means thereon and adapted to receive the supply pipe thereon in sliding and sealing engagement, and means on said coupling member for fastening said coupling member to the end surface of the trunion shaft.

* * * * *